US005319283A

United States Patent [19]

Elwell

[11] Patent Number: 5,319,283

[45] Date of Patent: Jun. 7, 1994

[54] DIMMER SWITCH WITH GRADUAL REDUCTION IN LIGHT INTENSITY

[75] Inventor: Brian Elwell, Brentwood, Calif.

[73] Assignee: Novitas, Inc., Culver City, Calif.

[21] Appl. No.: 935,771

[22] Filed: Aug. 26, 1992

Related U.S. Application Data

[63] Continuation-in-part of Ser. No. 740,262, Aug. 5, 1991, abandoned.

[51] Int. Cl.[5] ..... G05F 1/00

[52] U.S. Cl. ..... 315/194; 315/360; 315/307; 315/291; 315/362

[58] Field of Search ..... 315/194, 360, 307, 291, 315/362

[56] References Cited

U.S. PATENT DOCUMENTS

| | | | |
|---|---|---|---|
| 3,684,919 | 8/1972 | Cramer | 315/194 |
| 3,890,562 | 6/1975 | West | 315/194 X |
| 4,649,323 | 3/1987 | Pearlman et al. | 315/307 X |
| 4,651,060 | 3/1987 | Clark | 315/194 X |
| 4,733,138 | 3/1988 | Pearlman et al. | 315/307 X |
| 5,066,896 | 11/1991 | Bertenshaw et al. | 315/291 |
| 5,179,324 | 1/1993 | Audbert | 315/194 |

*Primary Examiner*—Robert J. Pascal
*Assistant Examiner*—Reginald A. Ratliff
*Attorney, Agent, or Firm*—Robbins, Berliner & Carson

[57] ABSTRACT

A time-delayed, variable light intensity control is configured to operate in a conventional mode in which the illumination level of incandescent lights is adjusted in accordance with rotation of the dimmer knob and in automatic dimming modes in which the illumination level is further dimmed over a predetermined period of time, to either a low level of illumination suitable for use as a night light, or until extinguished. The light intensity control controls the illumination levels as well as the time delay during automatic dimming by varying the phase angle at which a power triac is triggered. The phase angle is controlled by the timing of the generation of a first pulse in accordance with the rotation of the dimmer knob and the generation of a fixed period pulse which occurs one half cycle later. The control system is useful for other AC control systems.

11 Claims, 3 Drawing Sheets

DIMMER SWITCH WITH GRADUAL REDUCTION IN LIGHT INTENSITY

BACKGROUND OF THE INVENTION

Origin of the Invention

This is a continuation in part of application Ser. No. 07/740,262, filed Aug. 5, 1991, now abandoned.

FIELD OF THE INVENTION

The present invention relates to AC control systems, such as motor speed controllers and illumination dimmer switches.

DESCRIPTION OF THE PRIOR ART

Conventional AC control systems, including motor speed controllers and illumination dimmer switches, often use thyristors to vary the speed of the motor or intensity of illumination of incandescent lights. Such speed control devices are similar in nature and construction to such dimmer switches and will be discussed in terms of dimmer switches for convenience of description, although such descriptions apply equally well to speed control devices.

Conventional dimmer switches typically use variable resistances, in the form of potentiometers connected to a manually operated dimmer knob, to vary the firing angle of the thyristor to control the portion of the sinusoidal AC supply voltage during which the light is illuminated. In such systems, the firing angle is typically varied between about 30½ and about 150½ within each half cycle of the AC supply voltage to vary the light intensity from maximum to minimum brightness.

In such conventional systems, the dimmer knob is often also used to actuate an on/off switch in addition to the illumination control potentiometer in order to fully extinguish the illumination. Both diacs and triacs have been used as the thyristors in such dimmer control circuits, but diacs are presently preferred for reasons of economy and simplicity. Although the use of diacs in such circuits has provided a simplification of the circuitry for conventional dimmers, their use does not lend itself to more sophisticated control circuitry. Triacs, although potentially more controllable, have in the past been somewhat more difficult to use because of an operating characteristic of such devices known as reverse commutation. Triacs, once triggered, will remain activated during the remainder of that half cycle of sinusoidal supply voltage but reverse commutation causes the triacs to be reset and turned off by the zero crossing of the supply voltage at the beginning of the next half cycle.

In addition to on/off and variable intensity controls, conventional devices are known which are operable to provide a delay of a predetermined time period before the switching action is completed. Such devices permit, for example, a person to operate a light switch from across a room and get into bed before the light is switched out. Other conventional devices are known which provide increased power to a lamp in response to relatively loud sounds and reduced power in response to relatively quiet sounds so that the light flickers in response to the varying amplitude of the sound. U.S. Pat. No. 3,898,383 to Herbits, for example, discloses one such device which is illuminated in response to the presence of sound above a preselected level and is then automatically dimmed.

With regard particularly to dimmer switches, it is also known that a gradual reduction in lighting intensity has beneficial effects, particularly sleep inducing effects. Such sleep inducing effects are especially noticeable with young children and may be even more profound when coupled with a continuing low level of illumination during the remainder of the sleep period, such as the low level of illumination provided by a night light.

What are needed are improved techniques for controlling thyristors in dimming and similar speed control circuits and, in particular, circuits capable of more than the conventional on/off and illumination level controls, such as a gradual light reduction and/or night light control.

SUMMARY OF THE INVENTION

The present invention provides an AC power control system, for use as a motor speed controller or an illumination dimmer switch, including a triac operated in both half cycles of the sinusoidal AC supply voltage by the combination of a timed pulse responsive to the dimmer or speed control knob and a second cycle pulse responsive to the timed pulse. In a preferred embodiment, the triac dimmer control system provides additional operating modes in which the illumination intensity will decrease from its dimmer setting level to either a low level of illumination for use as a night light or to full extinguishment of the illumination so that the light is fully off.

In a first aspect, the present invention provides an AC control system including a zero crossing detector for detecting zero crossings in one direction of a sinusoidal AC source, adjustable timer means for generating a variable timer output pulse at an adjustable time period after a zero crossing is detected, fixed timer means for generating a fixed timer output pulse at a fixed time period after the variable timer output pulse is generated, the fixed time period being equal to about one half of a period of the sinusoidal AC source, and thryister means responsive to the adjustable timer output and fixed timer output pulses for connecting a load to a portion of a first and a second half cycle of the sinusoidal AC source related to the adjustable time period.

In another aspect, the present invention provides a method of controlling the application of an AC source to a load by detecting zero crossings in one direction of a sinusoidal AC source, generating a variable timer output pulse at an adjustable time period after a zero crossing is detected, generating a fixed timer output pulse at a fixed time period after the variable timer output pulse is generated, the fixed time period being equal to about one half of a period of the sinusoidal AC source, and applying the pulses to trigger a triac circuit to connect a load to a portion of a first and a second half cycle of the sinusoidal AC source, the portion being related to the adjustable time period.

The foregoing and additional features and advantages of this invention will become further apparent from the detailed description and accompanying drawing figures that follow. In the figures and written description, numerals indicate the various features of the invention, like numerals referring to like features throughout for both the drawing figures and the written description.

BRIEF DESCRIPTION OF THE DRAWINGS

A complete understanding of the present invention and of the above advantages may be gained from a consideration of the following description of the preferred embodiments taken in conjunction with the accompanying drawings in which.

DETAILED DESCRIPTION OF A PREFERRED EMBODIMENT

Figure 1A:
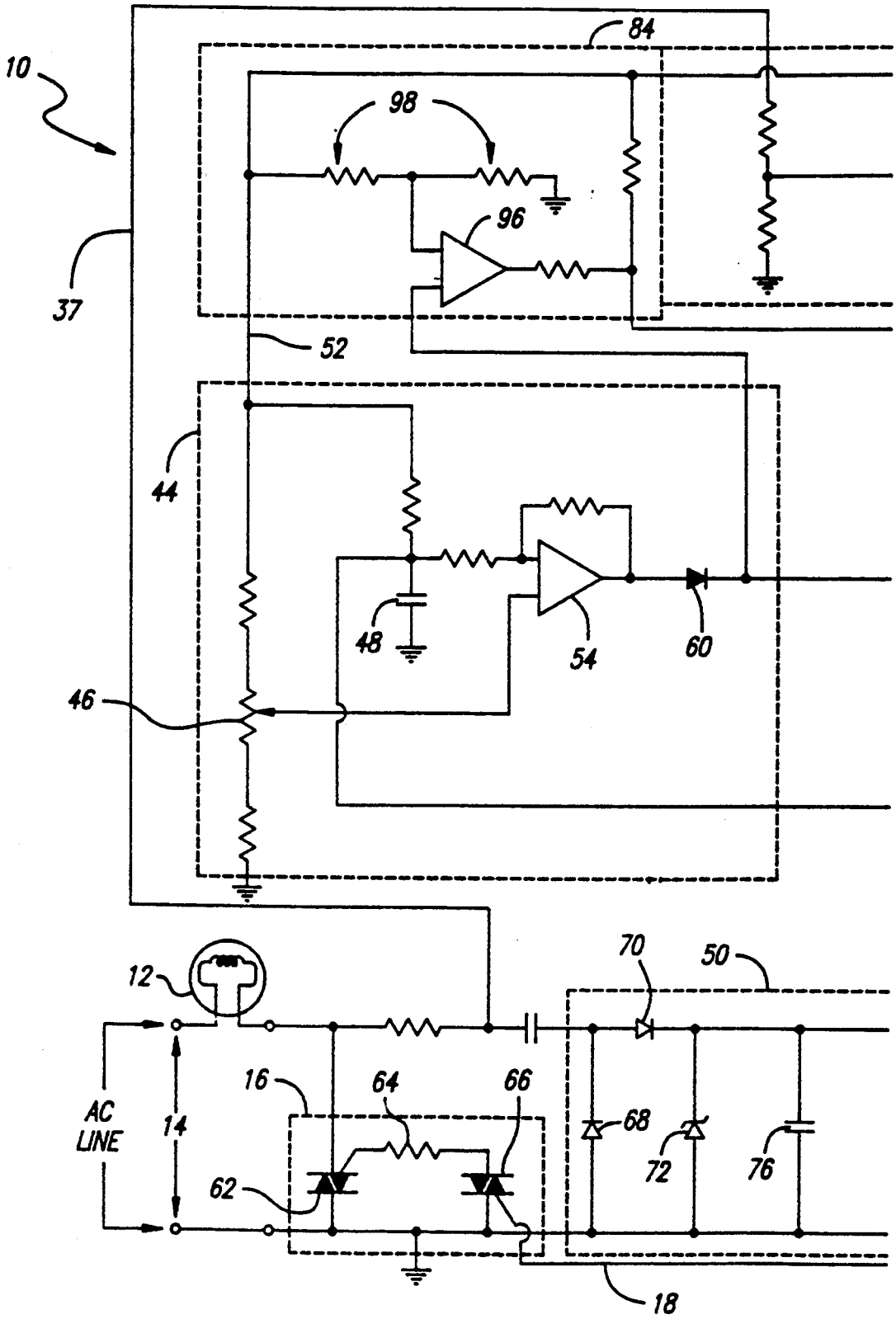
FIG. 1(*a*) and FIG. 1(*b*) are a schematic representative of a light intensity control or dimmer switch according to a preferred embodiment of the present invention.
Figure 1B:
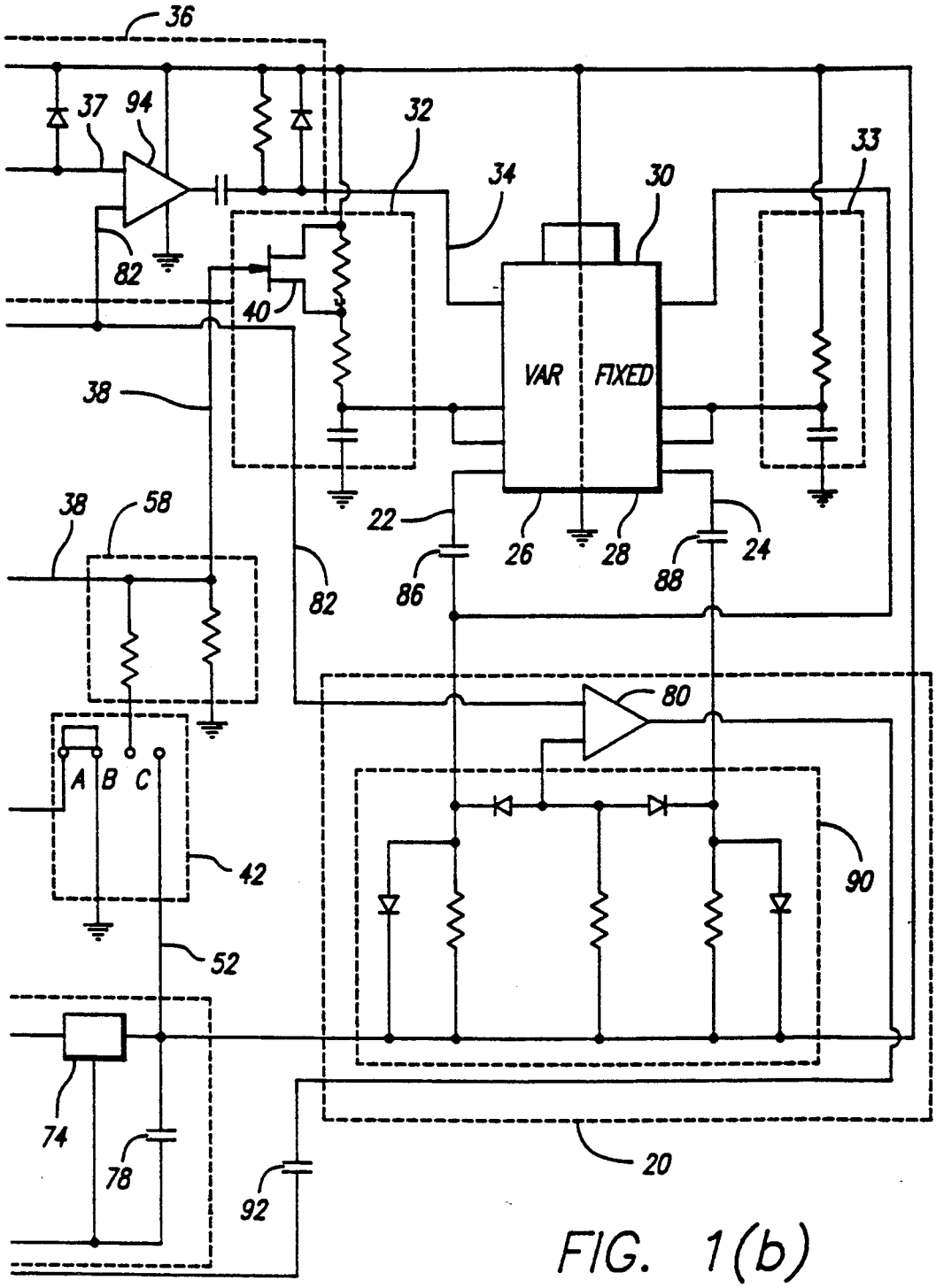

FIG. 1(*a*) and FIG. 1(*b*) are a schematic representation of an AC control system 10 used to control the power applied to a load, such as the intensity of illumination of an incandescent light 12, by varying the portion of the cycle of sinusoidal voltage connected thereto from an AC voltage source, such as the AC power source 14. The connection between the incandescent light 12 and the AC power source 14 is completed by a triac switching circuit 16 in response to a trigger signal 18, generated by a pulse generator 20. The trigger signal 18 is generated in response to a pair of timer outputs 22 and 24 from a pair of variable and fixed timers 26 and 28 which may conveniently be part of a dual timer 30.

The variable timer output 22 from the variable timer 26 is produced under the control of a variable RC time constant circuit 32 in response to a variable timer reset pulse 34 from a zero crossing detector circuit 36 which monitors positive going zero crossings in the AC power source 14 by means of a monitor input 37. The timing of the occurrence of the variable timer output 22 after the occurrence of a variable timer reset pulse 34 in response to the zero crossing detector circuit 36 is controlled by a level control voltage 38 applied as the gate input to an FET 40 within the variable RC time constant circuit 32 to control the time constant thereof.

The level control voltage 38 is generated in one of three modes of operation, described below in greater detail with respect to a mode control switch 42, by a level control circuit 44 in response to the setting of a potentiometer 46 which may conveniently be a dimmer switch potentiometer of the type manipulated by the dimmer knob in conventional dimmer control switches.

In particular, the potentiometer 46 may be part of a conventional on/off dimmer switch in which proper operation of the dimmer switch knob, not shown, attached thereto may be used to turn the system on and off by applying or disconnecting the AC power source 14 from the series circuit including the incandescent light 12 and the AC control system 10 by means of a conventional switch, not shown.

Most of the circuitry described so far, the pulse generator 20, the dual timer 30, the variable RC time constant circuit 32, the zero crossing detector circuit 36 and the level control circuit 44 are low level or logic circuits requiring a relatively low DC voltage level, such as 5 volts DC, which is provided by a voltage regulator 50 which provides the regulated DC voltage 52 from the AC power source 14.

Referring now to the modes of operation of the AC control system 10, the mode control switch 42 is shown in a first of three switch positions, designated for convenience as the A or dimmer switch position, in which one side of a capacitor 48 in the level control circuit 44 is grounded. The other side of the capacitor 48 is always grounded, so in switch position A, the capacitor 48 is effectively removed from the circuit and one input of a comparator, such as the comparator 54 in the level control circuit 44, is thereby grounded through a resistor so that the DC voltage applied thereto is fixed by the selection of component values.

The other input of the comparator 54 in the level control circuit 44 is provided by the setting of the potentiometer 46 so that the level of the level control voltage 38 applied to the FET 40 in the variable RC time constant circuit 32 is provided by the center tap of the potentiometer 46 and is therefore set by the adjustment of the potentiometer 46. The timing of the generation of the variable timer output 22 from the variable timer 26, with respect to the zero crossing of the AC power source 14 detected by the zero crossing detector circuit 36 and applied as the variable timer reset pulse 34, is therefore directly controlled by the setting of the potentiometer 46.

In the AC control system 10, the timing of the variable timer output 22 is used to control the firing angle of the triac switching circuit 16 between about 30° and about 150° in the first half cycle of the AC supply voltage 14 to vary the intensity of the AC power applied.

Figure 2:
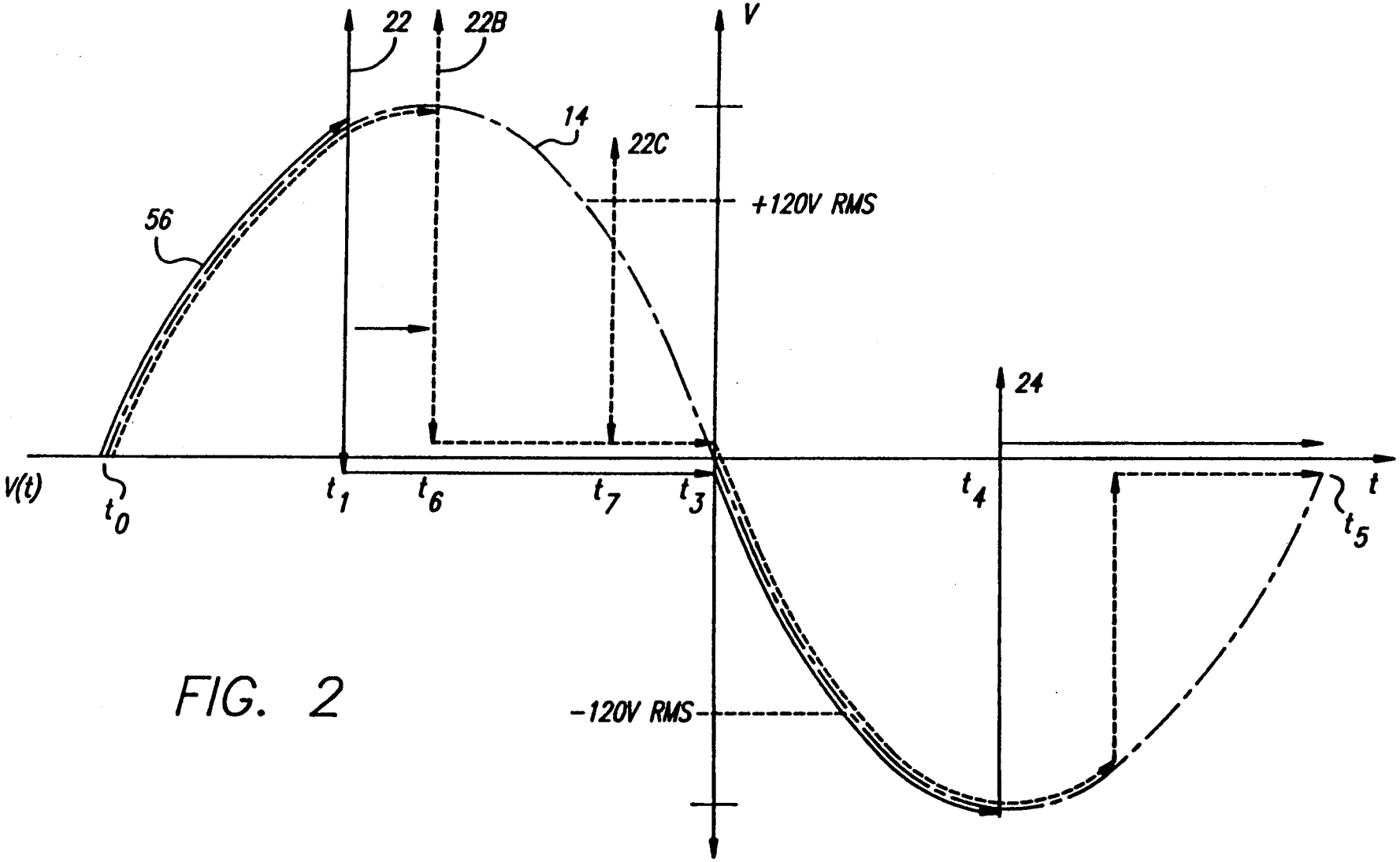
FIG. 2 is a graph of voltage as a function of time illustrating the firing angles of the thyristor for illumination level control of the present invention.

FIG. 2 is a graph of the AC power source voltage 14 as a function of time on which is superimposed the thyristor voltage 56, the voltage across the triac switching circuit 16 during the same time period. Because the triac switching circuit 16 is in series with the incandescent light 12, the light is illuminated when the triac switching circuit 16 operates as a closed switch and the thyristor voltage 56, which is the voltage across the switch, is zero. The light is extinguished when the triac switching circuit 16 operates as an open switch and the thyristor voltage 56 is the same as the voltage across AC power source 14.

For the purposes of this description, both graphs may be considered to start at time to, a zero crossing of the AC power source 14. At time t0, the zero crossing detector circuit 36 detects the zero crossing of the AC power source 14 and generates the variable timer reset pulse 34 applied as a reset to the variable timer 26. As noted above, the setting of the potentiometer 46 directly controls the time constant of the variable RC time constant circuit 32 and therefore the phase angle of the variable timer output 22 with respect to the zero crossing at time t0. The variable timer output 22 would therefore be generated at time t1, after a time delay related to the effective time constant of the variable RC time constant circuit 32.

When the variable timer output 22 is generated, the triac switching circuit 16 is triggered so that the thyristor voltage 56 drops to zero as the triac switching circuit 16 begins to conduct and the incandescent light 12 is illuminated. In accordance with the normal operation of a triac, however, reverse commutation operates at time t3, the next zero crossing, to turn the triac switching circuit 16 off again. In accordance with a conventional triac system, the triac switching circuit 16 would remain off and the thyristor voltage 56 would follow the voltage across the AC power source 14 until the next positive zero crossing detected by the zero crossing detector circuit 36.

In accordance with the present invention, however, the variable timer output 22 is also applied, through an appropriate isolation capacitor, as a reset input to the fixed timer 28. The fixed timer output 24 is generated after a predetermined time period in accordance with the time constant of the fixed RC time constant circuit 33. It is particularly convenient in accordance with the present invention to set the fixed time constant of the fixed RC time constant circuit 33 to one half cycle of the 60 cycle AC power source 14 or about 8.3 milliseconds. That is, the fixed timer output 24 is always generated at about the same point in the second half cycle of the sinusoidal voltage as the variable timer output 22 occurs in the first half cycle.

In this way, since the variable timer output 22 resets the fixed timer 28 which generates the fixed timer output 24 one half cycle or 180° later, the reverse commutation problem associated with the operation of triacs to control AC systems is resolved. In other words, even though the reverse commutation feature of triacs resets the triac after one half cycle, the fixed timer output 24 is automatically generated at the appropriate time to counter act this effect of reverse commutation and turn the triac on again at the same point in the second half cycle.

The fixed timer output 24 is generated at time t4 so that the triac switching circuit 16 is again triggered into its conducting state by the trigger signal 18 at approximately the same phase or firing angle in the second half cycle. The thyristor voltage 56 therefore tracks the voltage across the AC power source 14 from time t3 until time t4 at which time the fixed timer output 24 was generated. The triac switching circuit 16 then continues to conduct until the next zero crossing at time t5, at which time the zero crossing detector circuit 36 again detects a positive going zero crossing and generates the variable timer output 22 in accordance with the time constant of the variable RC time constant circuit 32.

The operation of the fixed timer 28 to provide a second pulse one half cycle or 180° delayed from the variable timer output 22 serves to resolve the reverse commutation problem in all switch positions of the mode control switch 42.

Referring now again to FIG. 1, the AC control system 10 may also be operated in either of two other modes of operation by positioning the mode control switch 42 in positions B or C. As described above, in switch position A, the firing angle of the trigger signal 18 is directly controlled by the setting of the potentiometer 46 so that the AC control system 10 operates in the manner of a conventional dimmer switch in that the illumination is increased when the potentiometer 46 is adjusted in one direction and decreased when the potentiometer 46 is adjusted in the other.

In switch position B, however, the capacitor 48 is no longer shorted to ground. For convenience, one or more legs of a resistor divider 58 may be connected to ground although this is not critical to the operation of the AC control system 10. When the capacitor 48 is not shorted to ground, the operation of the AC control system 10 is substantially different in that the firing angle of the trigger signal 18 is no longer set directly by the potentiometer 46, but rather changes as a function of the voltage across the capacitor 48. This voltage, when the mode control switch 42 is initially switched from switch position A to switch position B, is initially zero and builds up as the capacitor 48 charges as a result of the DC voltage 52.

When the voltage across the capacitor 48 is zero, the level control voltage 38 has the same value as it did in switch position A and the firing angle of the trigger signal 18 is unchanged. However, as the voltage across the capacitor 48 begins to increase, the difference between that voltage, which is applied through a resistor to one input of the comparator 54, and the voltage applied to the other input of the comparator 54 from the potentiometer 46, begins to decrease. As the difference across the inputs of the comparator 54 decreases, the level control voltage 38 decreases so that the voltage applied to the gate of the FET 40 decreases, changing the time constant of the variable RC time constant circuit 32.

Therefore, when the mode control switch 42 is moved from switch position A to switch position B, the level control voltage 38 begins to decrease as the voltage across the capacitor 48 increases. The time delay between the generation of the variable timer reset pulse 34 and the generation of the variable timer output 22 therefore increases, increasing the firing angle of the trigger signal 18 and reducing the illumination of the incandescent light 12.

Referring now again to FIG. 2 to further illustrate this operation, when the mode control switch 42 is first moved to switch position B, the variable timer output 22 is generated at the firing angle shown at time tl. As the voltage across the capacitor 48 builds up, the variable timer output 22 is generated at later and later times during the cycle, slowly reducing the percentage of the cycle during which the incandescent light 12 is illuminated. For the purpose of illustration, the variable timer output 22 during operation in switch position B is shown as the output 22B occurring at time t6. As the voltage across the capacitor 48 grows, time t6 moves from tl to time t3 gradually decreasing the illumination level from the light 12 until extinguished.

A suitable delay period, selected by selection of the various component values, from activation of the mode control switch 42 from the switch position A to the switch position B is about 30 minutes, assuming that the potentiometer 46 was adjusted to a fully bright illumination level. A capacitance value of about 220 microfarads is convenient for the capacitor 48 for this time period. Using the same component values, the time period would decrease as the illumination level selected by the potentiometer 46 in switch position A was decreased.

In other words, if the potentiometer 46 was set to half illumination, at which the firing angle of the trigger signal 18 would be about 90°, then the time delay as the illumination gently and automatically dimmed would be about half as long. Further adjustment of the potentiometer 46 while the AC control system 10 was operating in switch position B would further adjust this time period. Adjusting the potentiometer 46 in the direction towards less illumination would further reduce the delay period during which the illumination automatically dimmed until it was extinguished.

Referring now again to FIG. 1, the Operation of the AC control system 10 in the mode resulting from operation in switch position C will now be described. The primary difference in operation between switch positions B and C results from the connection of one or more legs of the resistor divider 58 to the DC voltage 52 from the voltage regulator 50. When the mode control switch 42 is in switch position C, the level control voltage 38 cannot decrease below a fixed, preset value related to the relative component values, particularly those of the resistance legs of the resistor divider 58.

When the mode control switch 42 is first switched from switch position A to switch position C, the firing angle of the trigger signal 18 is controlled by the setting of the potentiometer 46 in the same manner as described above with regard to switch position B. Similarly as the voltage across the capacitor 48 grows, the level control voltage 38 decreases and the firing angle increases from time tl to time t5. In switch position C, however, the firing angle does not increase beyond a predetermined fixed value, shown as the output 22C at time t7. This results from the connection of the resistor divider 58 to the DC voltage 52 so that there is a minimum level control voltage 38 applied to the FET 40 of the variable RC time constant circuit 32 even when the difference between the inputs of the comparator 54 has become zero. A blocking diode 60, at the output of the comparator 54, prevents degradation of this minimum voltage by unwanted operation of the comparator 54 as a current sink.

Now that the operation of the AC control system 10 has been fully described, certain of the function elements will be discussed in greater detail.

The triac switching circuit 16 conveniently includes a power triac 62 operated by a resistor 64 in series with a trigger triac 66 in order to ensure that the triac switching circuit 16 operated properly in all four quadrants of operation.

The voltage regulator 50 provides regulated DC voltage 52 from the AC power source 14 using a pair of half wave rectifiers shown as the diodes 68 and 70 and a zener diode 72 to provide rectified, reduced voltage power to a DC power regulator 74. A pair of filter capacitors, shown as the capacitors 76 and 78, are applied across the input and output respectively of the DC power regulator 74 to provide a reasonably smooth regulated DC voltage for the regulated DC voltage 52 even when the triac switching circuit 16 has been switched on and the voltage drop there across is zero. The regulated DC voltage 52 may conveniently be on the order of 5 volts DC and the capacitance values of the capacitors 76 and 78 on the order of 220 and 2.2 microfarads, respectively.

The pulse generator 20 receives the variable and fixed timer outputs 22 and 24 through a pair of coupling capacitors, such as the coupling capacitors 86 and 88, and applies either such timer output as one of the inputs of a comparator 80, the other input of which is a bias control signal 82 provided by a bias control circuit 84 to be described below. Each timer output is applied to a diode-resistor network 90 in the pulse generator 20 which is connected to the regulated DC voltage 52 and serves to isolate the timer outputs from each other. The diode-resistor network 90 ensures that the timer outputs are allowed to quickly dissipate and not build up a charge across the coupling capacitors 86 and 88 which would bias the input of the comparator 80. The output of the comparator 80 is provided by a high pass coupling capacitor 92 to the triac switching circuit 16 as the trigger signal 18.

The comparator 80 may conveniently be configured from an operational amplifier and, in particular, conveniently be one of four such operational amplifiers on a quad op amp chip, such as a 324 logic chip. One of each of the other three op amps from a quad op amp chip may then conveniently be used to configure the zero crossing detector circuit 36, the level control circuit 44 and the bias control circuit 84.

The dual timer 30 may conveniently be a dual timer logic chip such as the 556 chip which contains a pair of individual and separate timers configured as the variable timer 26 and the fixed time 28. A pair of individual logic timer integrated circuits, such as a pair of 555 logic chips, may also be used. The fixed timer 28 uses the fixed RC time constant circuit 33 including a resistor and capacitor while the variable timer 26 uses the variable RC time constant circuit 32 which includes both fixed resistance and capacitance as well as a variable resistance in the form of the FET 40 to vary the time constant of the timer as noted above.

The zero crossing detector circuit 36 may be of any convenient conventional design and may utilize the op amp comparator 94 of the quad op amp logic chip discussed above. One input of the op amp comparator 94 of the zero crossing detector circuit 36 is provided by the monitor input 37 while the other input to the op amp comparator 94 is the bias control signal 82, from the bias control circuit 84, which is also applied to the comparator 80 in the pulse generator 20.

The bias control circuit 84 includes the comparator 96 which is the fourth of the operational amplifiers included in the quad op amp logic chip as discussed above. The comparator 96 receives the level control voltage 38 from the level control circuit 44 as one input and the center tap of a resistor voltage divider 98 connected to the regulated DC voltage 52 as its other input. The bias control circuit 84 serves to compare the level control voltage 38 against a fixed voltage value related to the regulated DC voltage 52 and alter the operation of the pulse generator 20 and the zero crossing detector circuit 36 by altering the inputs of the comparators 80 and 94, respectively. In this way, the control of the firing angle of the trigger signal 18 for the triac switching circuit 16 may be maintained within its effective range within about 30° and to about 150°.

While particular embodiments of the invention have been shown and described, it will be obvious to those skilled in the art that changes and modifications may be made without departing from the invention in its broader aspects and therefore the aim in the appended claims is to cover all such changes and modifications as followed in the true spirit and scope of the invention.

What is claimed is:

1. An AC control system, comprising:

a zero crossing detector for detecting zero crossings in one direction of a sinusoidal AC source;

adjustable timer means for generating a variable timer output pulse at an adjustable time period after a zero crossing is detected;

fixed timer means for generating a fixed timer output pulse at a fixed time period after said variable timer output pulse is generated said fixed time period being equal to about one half of a period of the sinusoidal AC source; and thyristor means responsive to said adjustable timer output and fixed timer output pulses for connecting a load to said AC source during a portion of a fist and a second half cycle of said sinusoidal AC source, said portion being related to said adjustable time period.

2. The system of claim 1 wherein the adjustable timer means further comprises:

dimmer means for providing an adjustable resistance to vary said adjustable time period; and third timer means for selectively reducing said portion as a function of time.

3. The system of claim 2 wherein said capacitance means further comprises:

switch means operable a) in a first mode in which said adjustable time period is related to said adjustable resistance, b) in a second mode in which said adjustable time period varies as a function of time to reduce said portion to effectively zero, and c) in a third mode in which said adjustable time period varies as a function of time to reduce said portion to a predetermined lower portion.

4. The system of claim 2 for use as a time variable dimmer switch in which the load is an incandescent light so that said portion controls the level of illumination of the light and said capacitance means further comprises:

switch means operable a) in a first mode in which said illumination level is related to said adjustable resistance, b) in a second mode in which said illumination level varies as a function of time to reduce said illumination level to effectively off, and c) in a third mode in which said illumination level varies as a function of time to reduce said illumination level to a predetermined low illumination level suitable for use as a night light.

5. The system of claim 3 wherein said function of time recess said illumination during a time period on the order of 30 minutes from the time at which said second mode is selected to provide the sleep inducing and enhancing effects of slowly dimming illumination.

6. A method of controlling the application of an AC source to a load, comprising the steps of:

detecting zero crossings in one direction of a sinusoidal AC source;

generating a variable timer output pulse at an adjustable time period after a zero crossing is detected;

generating a fixed timer output pulse at a fixed time period after said variable timer output pulse is generated, said fixed time period being equal to about one half of a period of the sinusoidal AC source; and applying said pulses to trigger a triac circuit to connect a load to said AC source during a portion of a list and second half cycle of said sinusoidal AC source, said portion being related to said adjustable time period.

7. The method of claim 6 wherein the step of generating a variable timer output pulse further comprises the steps of:

providing an adjustable resistance to vary said adjustable time period; and selectively applying capacitance to cause said adjustable time period to also vary as a function of time to reduce said portion as a function of time.

8. The method of claim 7 wherein the step of selectively applying capacitance further comprises the steps of:

operating a switch in a first mode in which said adjustable time period is related to said adjustable resistance;

operating said switch in a second mode in which said adjustable time period varies as a function of time to reduce said portion to effectively zero; and operating said switch in a third mode in which said adjustable time period varies as a function of time to reduce said portion to a predetermined lower portion.

9. The method of claim 7 in which the load is an incandescent light so that the portion controls the level of illumination of the light and the step of applying capacitance further comprises the steps of:

operating a switch in a first mode in which said illumination level is related to said adjustable resistance;

operating said switch in a second mode in which said illumination level varies as a function of time to reduce said illumination level to effectively off; and operating said switch in a third mode in which said illumination level varies as a function of time to reduce said illumination level to a predetermined low illumination level suitable for use as a night light.

10. The method of claim 8 in which said function of time reduces said illumination during a time period on the order of 30 minutes from the time at which said second or third mode is selected to provide the sleep inducing and enhancing affects of slowly dimming illumination.

11. The system of claim 3 wherein said function of time reduces said illumination during a time period on the order of 25 minutes for the time at which said third mode is selected to provide the sleep inducing and enhancing effects or slowly dimming illumination.

* * * * *